US007140450B2

(12) United States Patent
Reed

(10) Patent No.: US 7,140,450 B2
(45) Date of Patent: Nov. 28, 2006

(54) PERCUSSION TOOL

(75) Inventor: Teddy R. Reed, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 0 days.

(21) Appl. No.: 10/968,379

(22) Filed: Oct. 18, 2004

(65) Prior Publication Data

US 2006/0081387 A1 Apr. 20, 2006

(51) Int. Cl.
*E21B 1/12* (2006.01)
*E21B 1/14* (2006.01)
*E21B 1/24* (2006.01)
*E21D 7/10* (2006.01)

(52) U.S. Cl. ..... 173/48; 173/115; 173/216; 173/217

(58) Field of Classification Search ..... 173/48, 173/115, 201, 216, 217; 310/47, 50
See application file for complete search history.

(56) References Cited

U.S. PATENT DOCUMENTS 3,517,755 A * 6/1970 Badcock ..... 173/117
3,559,751 A 2/1971 Yamada
3,685,593 A * 8/1972 Amtsberg et al. ..... 173/14
3,718,193 A * 2/1973 Wanner ..... 173/117
4,349,074 A 9/1982 Ince
4,750,567 A 6/1988 Grossmann et al.
4,766,963 A * 8/1988 Hartwig et al. ..... 173/109
4,823,886 A 4/1989 Pyatov
4,835,410 A * 5/1989 Bhagwat et al. ..... 307/64
5,111,890 A 5/1992 Ranger et al.
5,129,467 A * 7/1992 Watanabe et al. ..... 173/75
5,435,397 A 7/1995 Demuth
5,456,324 A 10/1995 Takagi et al.
5,775,440 A 7/1998 Shinma
5,873,418 A 2/1999 Arakawa et al.
6,044,918 A * 4/2000 Noser et al. ..... 173/176
6,116,352 A 9/2000 Frauhammer et al.
6,457,535 B1 10/2002 Tanaka
6,520,266 B1 2/2003 Bongers-Ambrosius et al.
6,523,622 B1 * 2/2003 Berger et al. ..... 173/212
6,651,860 B1 * 11/2003 Artmann et al. ..... 173/109
6,938,704 B1 * 9/2005 Berger et al. ..... 173/201

OTHER PUBLICATIONS

Bosch Product Encyclopedia, www.boschtools.com, Oct. 1, 2003, pp. 1 and 2.

* cited by examiner

*Primary Examiner*—Stephen F. Gerrity
*Assistant Examiner*—Nathaniel Chukwurah
(74) *Attorney, Agent, or Firm*—Wells St. John P.S.

(57) ABSTRACT

A percussion tool is described and which includes a housing mounting a tool bit; a reciprocally moveable hammer borne by the housing and which is operable to repeatedly strike the tool bit; and a reciprocally moveable piston enclosed within the hammer and which imparts reciprocal movement to the reciprocally moveable hammer.

15 Claims, 2 Drawing Sheets

PERCUSSION TOOL

GOVERNMENT RIGHTS

The United States Government has rights in this invention pursuant to Contract No. DE-AC07-99ID13727 between the U.S. Department of Energy and Bechtel BWXT Idaho, LLC.

TECHNICAL FIELD

The present invention relates to percussion tools and more specifically to an electric hammer-drill arrangement, and which is useful in the construction and mining industries.

BACKGROUND OF THE INVENTION

The prior art is replete with numerous examples of rotary hammer driving mechanisms and hammer-drill arrangements and which are useful in construction and mining applications. In high power hammer-drill applications, compressed air driven hammer-drills are frequently employed in view of the high energy that can be delivered by such relatively lightweight man portable devices. However, in these previous prior art assemblies, the compressed air driven hammer-drills are very energy inefficient. In this regard, it has been calculated that these compressed air hammer-drills utilize only on the order of about 20% of the available energy delivered by the compressed air. As should be understood, and for example in commercial mining operations, this inefficiency results in significant power costs. Additionally, distributing a large quantity of compressed air to various work locations, such as in a mine, and other similar environments can require the fabrication of large, complex and expensive air piping systems.

To eliminate the need for compressed air, electric hammer drills have been produced but have had other limitations with respect to the amount of energy percussion that could be delivered. In these prior art arrangements, it has been well known that hammer-drill power is typically the product of the hammer impact energy per blow, and the blow frequency. In this regard, three avenues for increasing hammer effectiveness are available, those being, 1) increasing the hammer velocity, 2) increasing the hammer weight, and/or 3) increasing the hammer blow frequency. From experience there is an upper limit to the hammer velocity beyond which hammer and tool materials begin to fail. Furthermore, to the degree that the hammer weight is increased, the overall weight of the resulting tool and the tool vibration correspondingly increases. Still further, it has been known that increasing the hammer weight typically results in a reduction of the hammer blow frequency. This is due to the fact that as the hammer weight increases, it typically takes more time for the hammer to be reset and readied for another impact in view of the weight and corresponding friction, which acts upon the hammer.

A new and improved percussion tool which addresses these and other shortcomings of the prior art devices is the subject matter of the present application.

SUMMARY OF THE INVENTION

Therefore, a first aspect of the present invention relates to a percussion tool which includes a housing mounting a tool bit; a reciprocally moveable hammer borne by the housing, and which is operable to repeatedly strike the tool bit; and a reciprocally moveable piston enclosed within the hammer, and which imparts reciprocal movement to the reciprocally moveable hammer.

Another aspect of the present invention relates to a percussion tool which includes a housing mounting a tool bit, and which has a proximal and a distal end; a hammer which is reciprocally moveably mounted within the housing, and having a main body defining a first internal passageway, and which is positioned in substantially coaxial alignment relative to the rotatable tool bit; a reciprocally moveable piston received in the first internal passageway of the reciprocally moveable hammer; and a motor coupled to the reciprocally moveable piston to move the piston along a defined path of travel within the first internal passageway, the movement of the piston causing the hammer to reciprocally move and repeatedly strike the proximal end of the rotatable tool bit.

Still another aspect of the present invention relates to a percussion tool which includes a rotatable tool bit having a proximal and a distal end; a housing which is defined by a sidewall, and which has opposite first and second ends, and wherein the sidewall of the housing defines an internal passageway, and wherein the rotatable tool bit is rotatably mounted on the first end of the housing, and the proximal end of the tool bit is received in the internal passageway of the housing; a reciprocally moveable hammer having a main body with a first end, and an opposite second end, and an exterior and interior facing surfaces, and wherein the interior facing surface defines a passageway which extends substantially between the first and second ends of the main body, and wherein the reciprocally moveable hammer is reciprocally moveable along a given path of travel along the internal passageway as defined by the housing; a reciprocally moveable piston received within the passageway defined by the interior facing surface of the reciprocally moveable hammer, and wherein the piston further includes a piston rod which is mounted on the piston, and wherein a portion of the piston rod is located outside of the passageway which is defined by the interior facing surface of the reciprocally moveable hammer, and is received within the internal passageway as defined by the housing; a drive linkage having a first end, and an opposite second end, and wherein the drive linkage is substantially completed enclosed within the internal passageway as defined by the housing; a high voltage and/or high frequency electrical motor disposed in force transmitting relation relative to the first end of the drive linkage, and in rotatable driving relation relative to the tool bit, and wherein energizing the high voltage and/or high frequency electrical motor causes reciprocal motion to be imparted to the reciprocally moveable piston, and wherein the reciprocal movement of the piston has the effect of imparting reciprocal motion to the reciprocally moveable hammer so as to cause the first end of the reciprocally moveable hammer to repeatedly strike the proximal end of the rotatable tool bit, and rotation of the rotatable tool bit; and a voltage and/or frequency converter positioned remotely relative to the high voltage/high frequency electrical motor and which is electrically coupled to a source of low voltage and/or low frequency power source, and wherein the voltage and/or frequency converter provides a high voltage and/or high frequency voltage output which is supplied to the high voltage and/or high frequency electrical motor to energize same.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
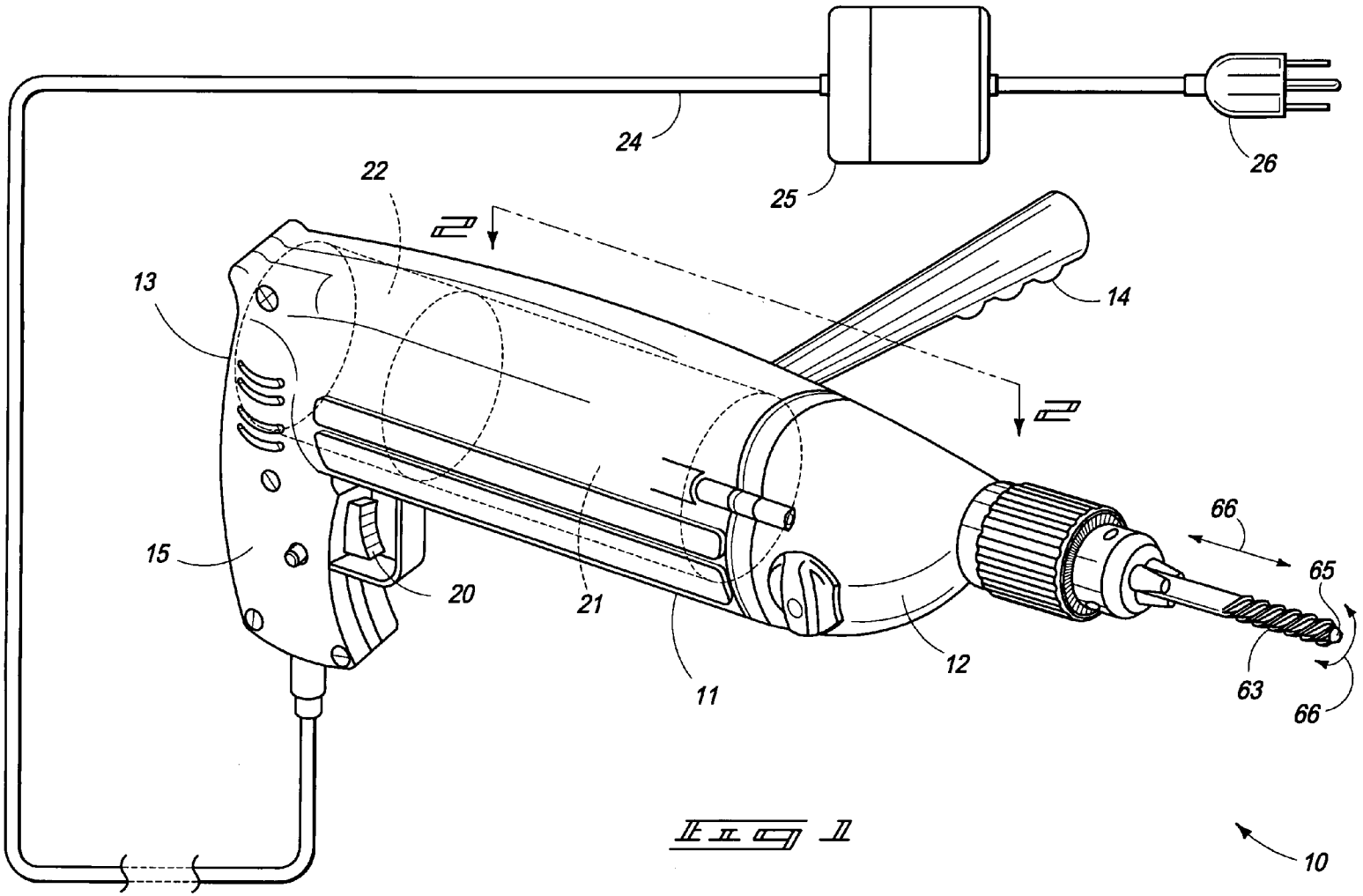
FIG. 1 is a greatly simplified view of a percussion tool which incorporates the features of the present invention.
Figure 2:
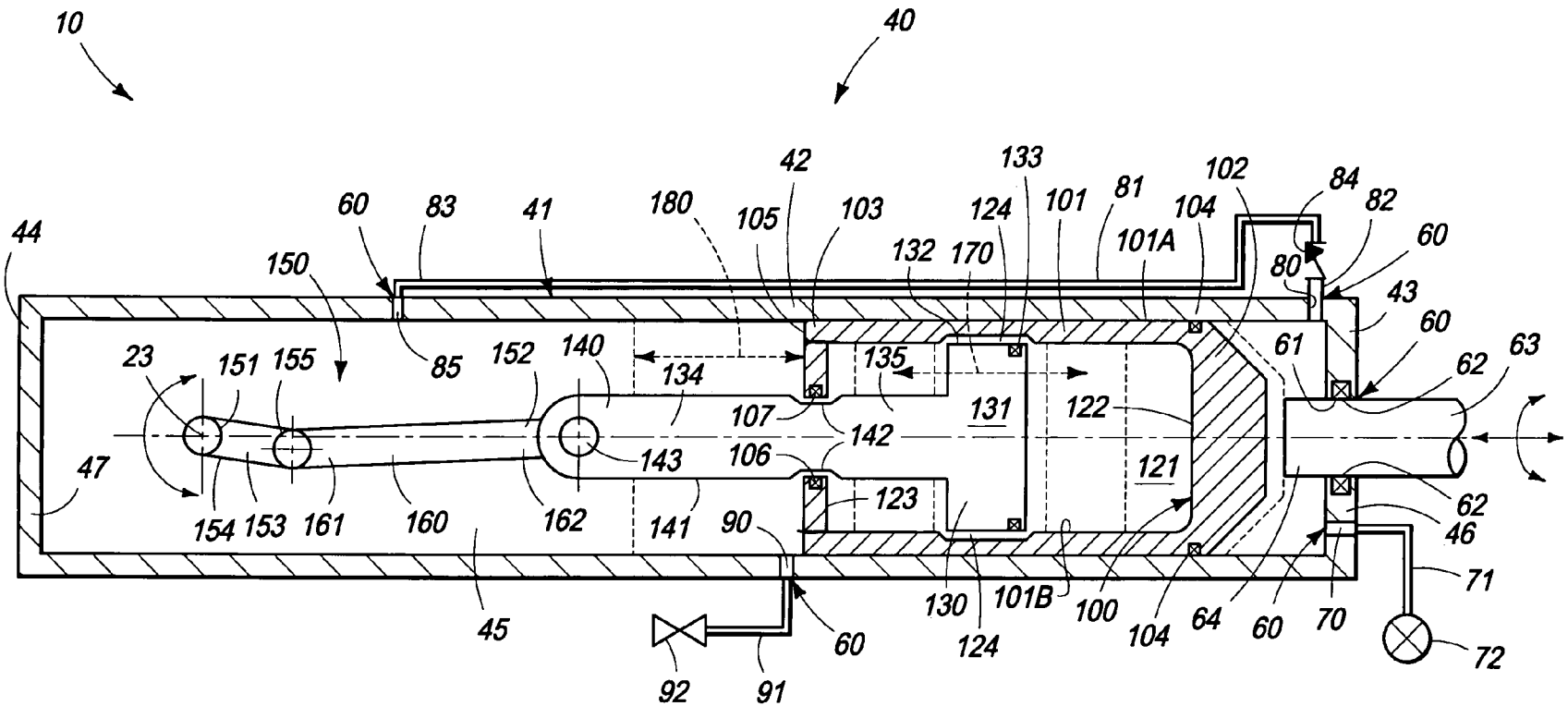
FIG. 2 is a greatly simplified, fragmentary, longitudinal, vertical sectional view taken through line 2—2 of FIG. 1.

The percussion tool of the present invention is generally indicated by the numeral 10 in FIGS. 1 and 2, respectively. As seen in FIG. 1, the percussion tool 10 includes an exterior housing 11 which has a first end 12 and an opposite second end 13. Positioned therebetween the first and second ends 12 and 13 is a first operator's handle 14. Still further, mounted adjacent to the second end 13 is a second operator's handle 15. Positioned adjacent to the second operator's handle 15 is a finger actuated trigger 20 which may be manipulated by an operator in order to operate the percussion tool 10. It should be appreciated that different handle arrangement may be utilized in the present invention. The exterior housing 11 defines a housing cavity 21 which receives, among other assemblies, a high voltage and/or high frequency electrical motor generally indicated by the numeral 22. This electrical motor 22, when energized, causes a corresponding reciprocal, and rotational movement of a tool bit, which will be described, below. As seen in FIG. 2, the electrical motor 22 has an output or drive shaft generally indicated by the numeral 23, the function of which will also be described, hereinafter. The high voltage and/or high frequency electrical motor 22 is electrically coupled to an electrical conduit 24 which allows the percussion tool 10 to be operated in a remote location relative to a source of electrical power. As illustrated in FIG. 1, a voltage and/or frequency and/or multi-phase converter 25 is positioned remotely relative to the high voltage/high frequency multi-phase electrical motor 22. This voltage and/or frequency and/or multi-phase converter 25 is then coupled to a low voltage and/or low frequency power source by means of a suitable electrical plug 26. For example, the source of electrical power could be a 120 volt, 50 Hz, single phase supply. The converter could then convert this available power to a 480 volt, 400 Hz, 3-phase output that is compatible with the electric motor mounted on the hammer drill. Furthermore, the output voltage and frequency of the converter may be adjustable to suit various drilling needs. It should be pointed out that other output and input values for voltage, frequency and the number of phases may be utilized than the values given in the example above. Furthermore, differences can be expected base on the type of available power and the electrical needs of the hammer drill motor.

Referring now to FIG. 2, the percussion tool 10 of the present invention includes a percussion assembly which is generally indicated by the numeral 40, and which is positioned within the housing cavity 21, and near the first end 12, of the exterior housing 11. As will be discussed in greater detail hereinafter, the percussion assembly is coupled in force receiving relation relative to the output or drive shaft 23 of the high voltage and/or high frequency electrical motor 22 as was discussed above. The percussion assembly 40 includes a housing, generally indicated by the numeral 41, and which is defined by a sidewall 42. The housing 41 has a first end 43, and an opposite second end 44. The sidewall 42 defines an internal passageway 45 which extends between the first and second ends 43 and 44, respectively. Yet further, the housing 41 includes a first end wall 46 positioned at the first end of the housing 43, and a second end wall 47 positioned at the second end 44 of the housing. As seen in FIG. 2, a plurality of apertures 60 are formed in the housing 41. In this regard, a first aperture 61 is formed in the first end wall 46. It will be seen in FIG. 2 that the first end wall 46 mounts a suitable seal 62 which defines, at least in part, the first aperture 61. The seal 62 is operable to sealably engage a rotatable, and reciprocally moveable tool bit generally indicated by the numeral 63. The tool bit has a proximal end 64 which is received, at least in part, in the internal passageway 45; and an opposite distal end 65 (FIG. 1) which comprises the working end of the tool bit, and which engages a work object or piece (not shown). As earlier discussed, the high voltage and/or high frequency electrical motor 22 is operable to impart both reciprocal, as well as rotational movement to the tool bit 63 as indicated by the lines labeled 66 (FIG. 1), in order to form a hole in a work object, not shown.

Referring still to FIG. 2, a second aperture 70 is formed in the first end wall 46 of the housing 41. This second aperture 70 is coupled in fluid flowing relation relative to a conduit 71, and which communicates with the ambient atmosphere. Positioned along the conduit 71 is an isolation valve generally indicated by the numeral 72, and which will be selectively positioned so as to allow fluid communication between the ambient environment, and the internal passageway 45 as will be discussed in greater detail hereinafter. A third aperture 80 is formed in the sidewall 42 of the housing 41 and is located near the first end 43. This aperture is coupled in fluid flowing relation relative to a conduit or passageway 81, and which has a first end 82 which is coupled in fluid flowing relation relative to the third aperture 80, and an opposite, second end 83. As seen in FIG. 2, a check valve 84 allows air which is received or is enclosed within the internal passageway 45, and near the first end 43 of the housing to move past the check valve 84 which is positioned therealong the conduit 81 and in the direction of the second end 83. As seen in FIG. 2, a forth aperture 85 is formed in the sidewall 42, and is located in a position that is near to the second end 44. In the arrangement as shown, the air which moves along the passageway 81 is returned to the internal passageway 45 by means of the fourth aperture 85. A fifth aperture 90 is formed in the sidewall 42 of the housing 41. This fifth aperture 90 is coupled in fluid flowing relation relative to a conduit 91 which communicates with the ambient atmosphere. A pressure control valve 92 is positioned along the conduit and allows for the selective passage of air between the ambient atmosphere, and the internal passageway 45.

Referring still to FIG. 2, the percussion assembly 40 includes a reciprocally moveable hammer which is designated by the numeral 100, and which is moveable along a substantially coaxially aligned path of travel within the housing 41 to repeatedly strike the tool bit 63. The hammer 100 has a main body 101 which is defined by an exterior facing surface 101A, and an opposite interior facing surface 101B. The main body 101 of the reciprocally moveable hammer 100 also has a first end 102 which strikes the proximal end 64 of the tool bit 63, and an opposite second end 103. Positioned near the first end 102 of the main body 101 is a seal 104 which slideably and sealably engages the sidewall 42 of the housing 41. The seal 104 is operable to impede the movement of air received within the internal passageway 45, between the first end of the housing 43, and the opposite second end 44. The main body 101 further has an end wall 105, which is positioned at the second end 103 thereof, and further has an aperture 106 formed therein. The end wall 105 further mounts a seal 107 which defines, at least in part, the aperture 106. The operation of this seal 107 will be discussed in greater detail hereinafter.

Referring still to FIG. 2, the main body 101 of the reciprocally moveable hammer 100 defines a passageway 121 which has a first end 122 and an opposite second end 123. This passageway is operable to receive a reciprocally moveable piston which will be discussed in the paragraphs below. Yet further, individual, longitudinally disposed channels 124 are formed in the internal sidewall 101B at a position intermediate the opposite first and second ends of the passageway 121. The purpose of these discrete channels is to permit the flow of air from one side of the reciprocally moveable piston to the opposite side thereof as the piston reciprocally moves within the reciprocally moveable hammer 100. The reciprocally moveable piston is discussed in the paragraph immediately below.

A reciprocally moveable piston 130 is shown in FIG. 2, and is defined by a main body 131. The reciprocally moveable piston moves within the passageway 121 which is defined by the internal sidewall 101B of the reciprocally moveable hammer 100. The main body of the piston 131 includes a peripheral edge 132. A seal 133 is positioned about the peripheral edge 132, and is operable to, on the one hand, appropriately position the main body of the piston 131 within the passageway 121, and further to impede or restrict the movement of air received within the passageway 121. As discussed above, the channel 124 which is formed in the internal sidewall 101B allows for the movement of air from one side of the piston 130, to the other, as the piston passes by the respective channels 124. Otherwise, the seal 133 is operable to impede the movement of air from one side of the piston, to the other, thereby allowing air captured in the passageway 121 to be compressed when the main body of the piston 131 advances toward the first or second ends 102 or 103 of the main body of the reciprocally moveable hammer 100. The reciprocally moveable piston 130 also includes a piston rod 134 which is attached to same. The piston rod has a first end 135 which is mounted onto the main body of the piston 131, and an opposite second end 140 which is positioned in the internal passageway 45 as defined by the housing 41. The piston rod has an exterior facing surface 141. Yet further, at least one channel 142 is formed in the external surface 141, and allows the exchange of air between the passageway 121, which is defined by the internal sidewall 101B, and the internal passageway 45 which is defined by the housing 41. Therefore it will be seen that based upon the position of the reciprocally moveable piston 130, air may be exchanged between the passageway 121, and the internal passageway 45. This arrangement facilitates the equalization of pressure within the percussion assembly 40. Yet further, when the main body of the piston 131 is advanced past the channels 124, air captured within the passageway 121 may be placed into compression and utilized to efficiently move the reciprocally moveable hammer 100 along a path of travel, which will be discussed below such that it may repeatedly strike the proximal end 64 of the tool bit 63 with greater force and efficiency. A coupler 143, which may comprise a pin, shaft or other fastener assembly, is affixed to the second end 140 of the piston rod 134.

The second end 140 of the reciprocally moveable piston 130 is coupled in force receiving relation relative to a drive linkage which is generally indicated by the numeral 150. The drive linkage 150 has a first end 151, which is coupled in force receiving relation relative to the high voltage and/or high frequency electrical motor 23, by means of the drive shaft 23 which as illustrated in FIG. 2. The drive shaft is operable to rotate in a given direction as indicated by the arrow in that view. Still further, the drive linkage 150 has a second end 152 which is coupled in force transmitting relation relative to the reciprocally moveable piston 130. As illustrated in FIG. 2, the drive linkage 150 is sealably positioned entirely within the internal passageway 45 which is defined by the housing 41. The drive linkage 150 further includes a first portion 153, and which has a first end 154 which is disposed in force receiving relation relative to the motor 22; and an opposite second end 155. Still further, the drive linkage includes a second portion 160 which has a first end 161, which is rotatably attached to the second end 155 of the first portion 153, and an opposite second end 162 which is rotatably or moveably affixed to the reciprocally moveable piston 130 and more specifically the second end 140 of the piston rod 134 by way of the coupler 143. Each of the respective first and second portions 153 and 160 have a length dimension. In the illustration as seen in FIG. 2, the second portion 160 has a length dimension greater than the first portion. When the high voltage and/or high frequency electrical motor 22 is energized, the drive linkage 150 is operable to impart force to the reciprocally moveable piston 13 so as to cause it to reciprocally move along a path of travel which is generally indicated by the numeral 170. The reciprocal movement of the piston 170 along the passageway 121 has the effect of correspondingly imparting reciprocal motion of the hammer 100 along a path of travel 180 within the internal passageway 45. This reciprocal motion of the hammer along the path of travel 180 causes the reciprocally moveable hammer 100 to repeatedly strike the proximal end 64 of the tool bit 63. As earlier discussed, the high voltage and/or high frequency electrical motor 22 is also operable to rotate the tool bit 63 such that the tool bit may efficiently form a hole in a work object (not shown).

OPERATION

The operation of the described embodiment of the present invention is believed to be readily apparent and is briefly summarized at this point.

In its broadest aspect, the percussion tool 10 of the present invention includes a housing 41 mounting a tool bit 63; and a reciprocally moveable hammer 100 is borne by the housing 41 and is operable to repeatedly strike the tool bit. Still further, the percussion tool 10 includes a reciprocally moveable piston 130 which imparts reciprocal movement to the reciprocally moveable hammer 100. Another aspect of the present invention relates to a percussion tool 10 which includes a housing 41 mounting a tool bit 63, and which has a proximal end 64 and a distal end 65. The percussion tool 10 includes a hammer 100 which is reciprocally moveably mounted within the housing 41, and which has a main body 101 defining a first internal passageway 121. The main body 101 of the hammer 100 is positioned in substantially coaxial alignment relative to the proximal end 64 of the rotatable tool bit 63. The invention 10 includes a reciprocally moveable piston 130 which is received in the first internal passageway 121 of the reciprocally moveable hammer 100. Yet further, the invention 10 includes a high voltage and/or high frequency electrical motor 22 which is coupled in the force transmitting relation relative to the reciprocally moveable piston 130 to move the piston along a defined path of travel 170 within the first internal passageway 121. The movement of the piston 130 causes the hammer 100 to reciprocally move along a path of travel 180 and repeatedly strike the proximal end 64 of the rotatable tool bit.

In the arrangement as seen in FIG. 2, a drive linkage 150 is provided and which has a first end 151 which is coupled in force receiving relation relative to the high voltage and/or high frequency electrical motor 22, and a second end 152 which is disposed in force transmitting relation relative to the reciprocally moveable piston 130. As earlier discussed, the drive linkage is sealably enclosed within the housing 41. Although, in some arrangements, this may not be necessary.

In the arrangement as shown in FIG. 2, the housing 41 is defined by a sidewall 42. Still further the housing has opposite first and second ends 43 and 44, respectively. The sidewall of the housing further defines a second internal passageway 45. As seen in that drawing, the proximal end 64 of the tool bit 63 cooperates with the first end of the housing 43, and the reciprocally moveable hammer 100 moves along the defined path of travel 180 within the second internal passageway 45. In the arrangement as seen in FIG. 2, the proximal end 64 of the tool bit 63 is disposed in spaced relation relative to the first end 43 of the housing 41. As earlier discussed, the housing defines a third aperture, or air movement passageway 80 near the first end 43 thereof. This third aperture or air movement passageway 80 permits air which is captured between the first end of the housing 43 and the reciprocally moveable piston 130 to escape from the second internal passageway 45 and be returned to the second internal passageway 45 at a location between the second end of the housing 44 and the reciprocally moveable piston 130. This is accomplished by means of the conduit 81, and the fourth aperture 85, which is formed in the sidewall 42 of the housing 41.

In addition to the foregoing, the main body 101 of the reciprocally moveable hammer 100 has a first end 102 which repeatedly strikes the proximal end 64 of the tool bit 63 when influenced by the reciprocal motion of the piston 130 within the first internal passageway 121. Still further, the reciprocally moveable hammer has an opposite second end 103 which further defines an end wall 105 which has an aperture 106 formed therein. The reciprocally moveable piston 130 further comprises a piston rod 134 which has a first end 135 which is mounted on the moveable piston 130, and an opposite second end 140. In the arrangement as shown in FIG. 2, the piston rod 134 moves, at least in part, through the aperture 106 formed in the end wall 105. The second end of the piston rod 140 is disposed in force receiving relation relative to the drive linkage 150.

As seen in FIG. 2, the piston rod 134 has an exterior facing surface 141 which has a channel 142 formed therein and which is located intermediate the opposite first and second ends 135 and 140, respectively. This channel 142 couples the first internal passageway 121, which is defined by the hammer 100, in fluid flowing relation relative to the second internal passageway 45. The channel 142 permits air which is captured between the second end 103 of the hammer 100, and the reciprocally moveable piston 130, to escape, at least in part from the first internal passageway 121 when the piston 130, under the influence of force applied by the piston rod 134, draws the piston in the direction of the second end 103 of the hammer 100. This motion further allows air from the second internal passageway 45 to pass back into the first internal passageway 121 when the piston rod 134 applies force to the piston 130 to move the piston in the direction of the first end 102 of the hammer 100. As seen in FIG. 2, the reciprocally moveable piston 130 received in the first internal passageway 121 reciprocally moves along a path of travel 170 having a length dimension which is less than the length dimension of the first internal passageway 121. Still further, the internal sidewall 120 of the hammer 100 has a channel 124 formed therein. In the arrangement as shown, when air is captured in the first internal passageway 121, between the piston 130 and the first and second ends 102 and 103 of the hammer 100, the channel 124 permits, at least in part, the air captured in the first internal passageway 121 to move past the piston as the piston reciprocally moves along the path of travel 170.

The percussion tool 10 of the present invention also includes an arrangement wherein the passageway 45 may communicate in fluid flowing relation relative to the ambient atmosphere when the hammer 100 is positioned near the proximal end 64 of the tool bit. As seen in FIG. 2, the fifth aperture 90 is exposed when the hammer approaches the proximal end 64 of the tool bit 63 thereby allowing a pressure control valve 92 to control pressure in the region of the internal passageway 45 which is positioned behind the hammer 100. As should be understood, notwithstanding the best manufacturing efforts, some seal leakage may occur with the device. Therefore, apertures such as 60, 70, and 90 provide a convenient means whereby air and the pressure associated with same and which is captured within the internal passageway 45, may be controlled in order to prevent the undue buildup of pressure within the internal passageway 45. It should be noted that some pressure in passageway 45 may be desirable to prevent excessive movement at 102.

Therefore the percussion tool 10 of the present invention includes a rotatable tool bit 63 having a proximal 64 and a distal end 65, and a housing 40 which is defined by a sidewall 42, and which has opposite first and second ends 43 and 44, respectively. The sidewall of the housing defines an internal passageway 45, and the rotatable tool bit is rotatably mounted on the first end 43 of the housing, and the proximal end of the tool bit is received in the internal passageway 45 of the housing. The percussion tool 10 further includes a reciprocally moveable hammer 100 having a main body 101 with a first end 102, and an opposite second end 103. The reciprocally moveable hammer further has an exterior facing surface 101A, and an interior facing surface 101B, which defines a passageway 121 which extends substantially between the first and second ends of the main body. The reciprocally moveable hammer is reciprocally moveable along a given path of travel 180 along the internal passageway 45 as defined by the housing 40. A reciprocally moveable piston 130 is received within the passageway 121 which is defined by the interior facing surface of the reciprocally moveable hammer 100. The piston further includes a piston rod 134 which is mounted on the piston, and a portion of the piston rod is located outside of the passageway 121, and is received within the internal passageway 45 as defined by the housing 40. A drive linkage 150 is provided, and which has a first end 151, and an opposite second end 152. The drive linkage is substantially completed enclosed within the internal passageway 45 as defined by the housing 40. In addition to the foregoing, a high voltage and/or high frequency electrical motor 22 is provided, and which is disposed in force transmitting relation relative to the first end 151 of the drive linkage 150. This drive linkage is also disposed in rotatable driving relation relative to the tool bit. Still further, upon energizing the high voltage and/or high frequency electrical motor 22, the electrical motor causes reciprocal motion to be imparted to the reciprocally moveable piston 130. This reciprocal movement of the piston 130 has the effect of imparting a corresponding reciprocal motion to the reciprocally moveable hammer 100 so as to cause the first end 102 of the reciprocally moveable hammer 100 to repeatedly strike the proximal end 64 of the rotatable tool bit 63. The present invention further includes a voltage and/or frequency converter 25 which is positioned remotely relative to the high voltage/high frequency electrical motor 22 and which is electrically coupled to a source of low voltage and/or low frequency power. The voltage and/or frequency converter provides a high voltage and/or high frequency voltage output which is supplied to the high voltage and/or high frequency electrical motor to energize same.

Therefore it will be seen that the percussion tool 10 of the present invention provides numerous advantages over the prior art assemblies utilized heretofore including the reduction of weight by the utilization of a high voltage and/or high frequency electrical motor 22. Yet further, in view of the arrangement as shown in FIG. 2, increased amounts of percussive energy can be applied to the proximal end 64 of the tool bit 63 without a corresponding increase in the weight of the tool, thereby making it more useful in various operational environments.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A percussion tool, comprising:

a housing defining a passageway having first and second ends and which further mounts a tool bit which has a proximal and a distal end, and wherein air is received within the passageway;

a hammer which is reciprocally moveably mounted within the passageway as defined by the housing, and having a main body defining a first internal passageway, and which is positioned in substantially coaxial alignment relative to the tool bit, and wherein air is received within the first internal passageway, and wherein the main body further has a first end which is operable to repeatedly strike the tool bit, and an opposite second end defining an end wall which has an aperture formed therein and which mounts a seal;

a reciprocally moveable piston received in the first internal passageway of the reciprocally moveable hammer, and wherein the air which is received within the first internal passageway can periodically pass by the piston, and be exchanged with the air which is received in the passageway defined by the housing;

a piston rod having a first end which is mounted on the piston, and an opposite second end, and wherein the piston rod reciprocally moves, at least in part, through the aperture formed in the side wall, and is sealably engaged by the seal;

a motor coupled to the second end of the reciprocally moveable piston rod and which is operable to move the piston along a defined path of travel within the first internal passageway, and wherein the movement of the piston causes the first end of the hammer to reciprocally move and repeatedly strike the proximal end of the rotatable tool bit, while simultaneously causing the air which is received within the passageway defined by the housing to be compressed;

an air passageway which fluidly couples the first end of the passageway defined by the housing with the second end of the passageway, and wherein air within the air passageway can move from the first end of the housing to the second end of the housing to equalize air pressure within the housing; and a valve disposed in fluid metering relation relative to the air passageway.

2. A percussion tool as claimed in claim 1, and further comprising:

a drive linkage having a first end which is coupled in force receiving relation relative to the motor, and a second end which is disposed in force transmitting relation relative to the second end of the reciprocally moveable piston rod, and wherein the drive linkage is enclosed within the housing, and wherein the drive linkage is wholly received within the passageway defined by the housing.

3. A percussion tool as claimed in claim 2, and wherein the drive linkage further comprises: a first portion having a first end which is disposed in force receiving relation relative to the motor, and an opposite second end; and a second portion having a first end which is rotatably attached to the second end of the first portion, and an opposite second end which is affixed to the reciprocally moveable piston.

4. A percussion tool as claimed in claim 3, and wherein the first and second portions each have a length dimension, and wherein the second portion has a length dimension greater than the first portion.

5. A percussion tool as claimed in claim 4, and wherein the proximal end of the tool bit is received in the passageway as defined by the housing, and wherein the reciprocal movement of the piston causes the reciprocally moveable hammer to move along a path of travel and to repeatedly strike the tool bit.

6. A percussion tool as claimed in claim 4, and wherein the proximal end of the tool bit is received in the passageway defined by the housing, and is disposed in spaced relation relative to the first end of the passageway, and wherein the reciprocally moveable hammer under the influence of the reciprocally moveable piston, repeatedly strikes the proximal end of the tool bit, and wherein the air passageway permits air which is captured between the first end of the passageway and the reciprocally moveable hammer to escape from the passageway defined by the housing, and be returned to the passageway at a location between the second end of the passageway and the reciprocally moveable hammer.

7. A percussion tool as claimed in claim 1, and wherein the piston rod has an exterior facing surface, and wherein a channel is formed in the exterior facing surface of the piston rod at a location intermediate the opposite first and second ends thereof, and wherein the channel couples the first internal passageway, which is defined by the hammer, in fluid flowing relation relative to the passageway as defined by the housing, and wherein the channel permits air, which is captured between the second end of the hammer, and the reciprocally moveable piston, to escape from the first internal passageway, and by the seal, at least in part, when the piston, under the influence of force applied by the piston rod, draws the piston in the direction of the second end of the hammer, and which further allows air from the passageway defined by the housing to pass into the first internal passageway when the piston rod applies force to the piston to move the piston in the direction of the first end of the hammer.

8. A percussion tool as claimed in claim 1, and wherein the motor is a high voltage and/or high frequency electrical motor.

9. A percussion tool as claimed in claim 8, and further comprising:

a voltage or frequency converter which is operable to receive a low voltage and/or frequency power source and convert it into a high voltage and high frequency power output, and wherein the high voltage and high frequency power output is supplied to the high voltage or high frequency electrical motor.

10. A percussion tool as claimed in claim 9, and wherein the voltage or frequency converter is positioned remotely relative to the high voltage and high frequency electrical motor, and wherein an electrical conduit electrically couples the voltage or frequency converter to the high voltage and high frequency electrical motor.

11. A percussion tool as claimed in claim 1, and wherein the tool bit is rotatable relative to the housing, and wherein the motor is coupled in rotatable driving relation relative to the tool bit.

12. A percussion tool, comprising:

a tool bit having a proximal and a distal end;

a housing which is defined by a sidewall, and which has opposite first and second ends, and wherein the sidewall of the housing defines an internal passageway, and wherein the tool bit is mounted on the first end of the housing, and the proximal end of the tool bit is received in the internal passageway of the housing;

a reciprocally moveable hammer having a main body with a first end, and an opposite second end, and an exterior and interior facing surfaces, and wherein the interior facing surface defines a passageway which extends substantially between the first and second ends of the main body, and wherein the reciprocally moveable hammer is reciprocally moveable along a given path of travel along the internal passageway as defined by the housing, and wherein the reciprocally movable hammer has an end wall which mounts a seal, and wherein the seal defines an aperture;

a reciprocally moveable piston received within the passageway which is defined by the interior facing surface of the reciprocally moveable hammer, and wherein the piston further includes a piston rod which is mounted on the piston, and wherein a portion of the piston rod extends through the aperture defined by the seal and is sealably engaged by the seal, and is further received within the internal passageway as defined by the housing;

a drive linkage having a first end, and an opposite second end, and wherein the drive linkage is substantially completely enclosed within the internal passageway as defined by the housing;

an electrical motor disposed in force transmitting relation relative to the first end of the drive linkage, and further in rotatable driving relation relative to the tool bit, and wherein energizing the electrical motor causes reciprocal motion to be imparted to the reciprocally moveable piston, and wherein the reciprocal movement of the piston has the effect of imparting reciprocal motion to the reciprocally moveable hammer so as to cause the first end of the reciprocally moveable hammer to repeatedly strike the proximal end of the tool bit, and rotation of the tool bit;

a voltage or frequency converter positioned remotely relative to the electrical motor and which is electrically coupled to a source of power, and wherein the voltage or frequency converter provides a voltage output which is supplied to the electrical motor to energize same;

an air passageway which couples the first end of the housing with the second end thereof, and wherein air is captured in the internal passageway defined by the housing, and between the first end of the hammer and the first end of housing, and wherein the air passageway couples the internal passageway near the first end of the housing, with the internal passageway located near the second end of the housing, and wherein the reciprocal movement of the hammer causes the captured air to be delivered to the internal passageway at a location which is between the second end of the housing and the second end of the reciprocally moveable hammer; and a valve disposed in fluid metering relation relative to the air passageway.

13. A percussion tool as claimed in claim 12, and wherein the passageway defined by the interior facing surface of the reciprocally moveable hammer is periodically coupled in fluid flowing relation relative to the internal passageway as defined by the housing.

14. A percussion tool as claimed in claim 12, and wherein a second air passageway couples the internal passageway as defined by the housing, and which is located between the second end of the housing, and the second end of the hammer, with ambient, when the reciprocally moveable hammer is moving in a direction along the internal passageway to strike the proximal end of the tool bit.

15. A percussion tool, comprising:

a reciprocally moveable hammer which has an internal sidewall defining a first passageway, first and second ends, and an end wall which defines an aperture, and wherein a seal is mounted on the end wall and defines the aperture;

a reciprocally moveable piston enclosed within the moveable hammer and which is reciprocally movable along a path of travel within the first passageway, and which imparts reciprocal movement to the moveable hammer;

a reciprocally movable piston rod mounted on the reciprocally movable piston, and which further has an exterior facing surface which has a channel formed therein, and wherein the piston rod extends through the aperture, and the seal engages the piston rod;

a housing having opposite first and second ends and defining a second passageway, and wherein the reciprocally moveable hammer is received within the second passageway and moves along a reciprocal path of travel between the first and second ends of the housing under the influence of the reciprocally movable piston, and wherein the channel formed in the piston rod periodically permits the exchange of air between the second passageway of the housing and the first passageway defined by the reciprocally movable hammer;

a tool bit mounted on the first end of the housing, and wherein a portion of the tool bit is received within the second passageway, and wherein the reciprocally moveable hammer repeatedly strikes the portion of the tool bit received within the second passageway as the hammer reciprocally moves along the reciprocal path of travel;

an air passageway having a first end which is located between the first end of the reciprocally moveable hammer and near the first end of the housing, and a second end which is located between the second end of the housing and the second end of the reciprocally moveable hammer, and wherein the air passageway allows air which is captured therebetween the first end of the reciprocally moveable hammer and the first end of the housing to travel along the air passageway and be received within the second passageway at a location between the second end of the housing and the second end of the reciprocally moveable hammer as the reciprocally moveable hammer moves along the second passageway; and a valve disposed in fluid metering relation relative to the air passageway.

* * * * *